United States Patent [19]

Poulter et al.

[11] Patent Number: 4,793,955

[45] Date of Patent: Dec. 27, 1988

[54] METHOD AND APPARATUS FOR CASTING SOLID PROPELLANT ROCKET MOTORS

[75] Inventors: Larry W. Poulter, Ogden; John L. Brown, Brigham City; Ernest D. Brown, Ogden, all of Utah

[73] Assignee: Morton Thiokol, Inc., Chicago, Ill.

[21] Appl. No.: 497,538

[22] Filed: May 24, 1983

[51] Int. Cl.[4] ..... C06B 21/00

[52] U.S. Cl. ..... 264/3.3; 149/2; 149/109.6; 425/461; 425/464; 264/3.1; 264/3.4

[58] Field of Search ..... 264/3 C, 3 R, 3 B, 3.1, 264/3.3, 3.4; 149/2, 109.6; 425/461, 464

[56] References Cited

U.S. PATENT DOCUMENTS 2,994,106 8/1961 Posey ..... 264/3 R 3,492,815 2/1970 McCullough ..... 264/3 R 3,713,395 1/1973 Carpenter ..... 102/290

4,442,666 4/1984 Vetter ..... 102/290 X

OTHER PUBLICATIONS

*Rocket Propellants*, Warren, Francis A., Reinhold Pub. Corp., N.Y., 1958, pp. 7, and 126–140.

*Primary Examiner*—Stephen J. Lechert, Jr.

*Attorney, Agent, or Firm*—Gerald K. White

[57] ABSTRACT

A circular slit plate having slits therein that are symmetrically positioned and originate near the center of the plate and extend radially toward the outer diameter thereof is used to deaerate solid rocket motor propellant and to provide a uniform propellant flow distribution during rocket motor casting.

18 Claims, 8 Drawing Sheets

PRIOR ART

PRIOR ART

METHOD AND APPARATUS FOR CASTING SOLID PROPELLANT ROCKET MOTORS

The government has rights in this invention pursuant to contract No. AD10C5070N, under Prime Contract No. N0003079C0116 with the U.S. Navy Department.

BACKGROUND OF THE INVENTION

1. Field of the Invention

This invention relates to an improved method of and apparatus for casting solid propellant rocket motors.

2. Description of the Prior Art

High performance, solid propellant rocket motors require void and defect free grains in order to maximize total impulse and obtain stable performance. Entrapped air and volatiles must be removed from the propellant when cast. Conventional means of propellant deaeration include extrusion of the uncured propellant through a slit plate into an evacuated chamber or motor case. Entrapped air and volatiles are flashed from the ribbons of propellant exiting the slit plate.

A conventional slit plate, as illustrated in FIG. 1 of the drawings, contains parallel rows of narrow slits each of which normally has a width of one-sixteenth to one-quarter inch (1/16"-¼"). This geometry provides a maximum cross sectional flow area. Laboratory tests conducted with such a parallel slit plate indicates that this geometry produces a non uniform propellant flow distribution. A typical flow pattern obtained with this geometry is illustrated in FIGS. 2A and 2B. Propellant ribbons leaving the slit plate stretch and elongate from their own weight. This results in narrowing or necking down of the ribbon thickness and width and the non uniform flow pattern illustrated in FIG. 2A. A non uniform flow pattern results in unequal filling of a rocket motor case and the formation of radially oriented interfaces and knit lines in the propellant grain. Such interfaces and knit lines are potential sources of grain failure.

Accordingly, there has existed a need and a demand for improvement in the art of casting solid propellant rocket motors to the end of avoiding and/or overcoming the aforementioned difficulties and problems.

SUMMARY OF THE INVENTION

An object of the invention is to provide an improved method of and apparatus for deaerating rocket motor propellant and for providing a uniform propellant flow distribution during rocket motor casting.

A more specific object of the invention is to provide a method of providing a uniform propellant flow distribution during rocket motor casting comprising the step of introducing into an evacuated chamber or motor case uncured propellant in the form of symmetrical, radially oriented, ribbons.

Another specific object of the invention is to provide an improvement in apparatus for extruding uncured propellant during rocket motor casting thereby to provide a uniform flow distribution and to avoid the aforementioned problems encountered in the prior art.

In accomplishing these objectives of the invention, uncured propellant is extruded through a radial slit plate into an evacuated chamber or motor case. The radial slit plate is circular and contains narrow, symmetrically oriented, slits originating near the center of th plate and extending radially towards the outer diameter of the plate. This slit plate geometry has been found to be insensitive to the effect of ribbon narrowing and necking down and provides a uniform propellant flow distribution.

BRIEF DESCRIPTION OF THE DRAWINGS

Having summarized the invention, a detailed description follows with reference being made to the accompanying drawings which form part of the specification, of which.

DESCRIPTION OF THE PREFERRED EMBODIMENTS

Laboratory tests, as follows, were conducted to demonstrate the application and utility of the method of and apparatus, according to the invention, for casting solid propellant motors.

EXAMPLE 1

Figure 1:
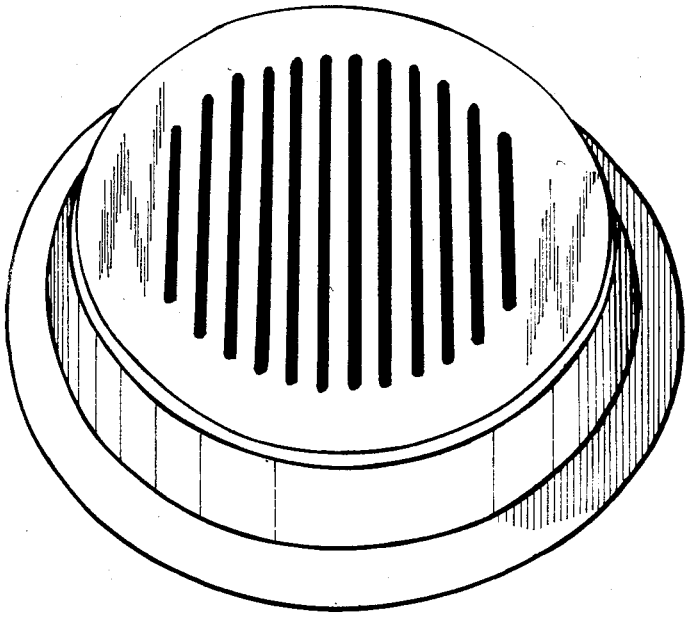
FIG. 1 illustrates the conventional prior art slit plate containing parallel rows of narrow slits for extruding uncured propellant to remove air and volatiles therefrom.
Figure 3:
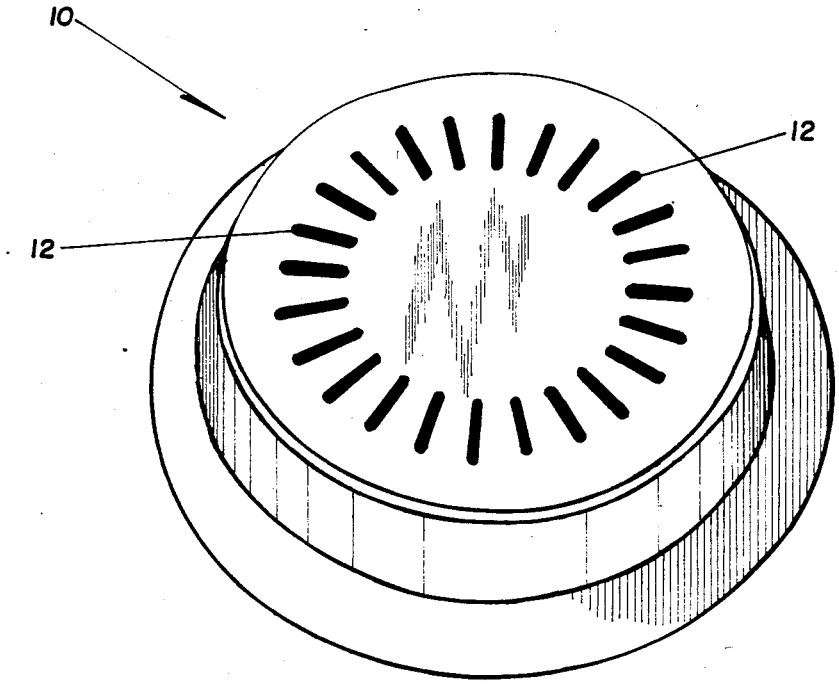
FIG. 3 illustrates a slit plate having radial slits according to the invention.
Figure 2A:
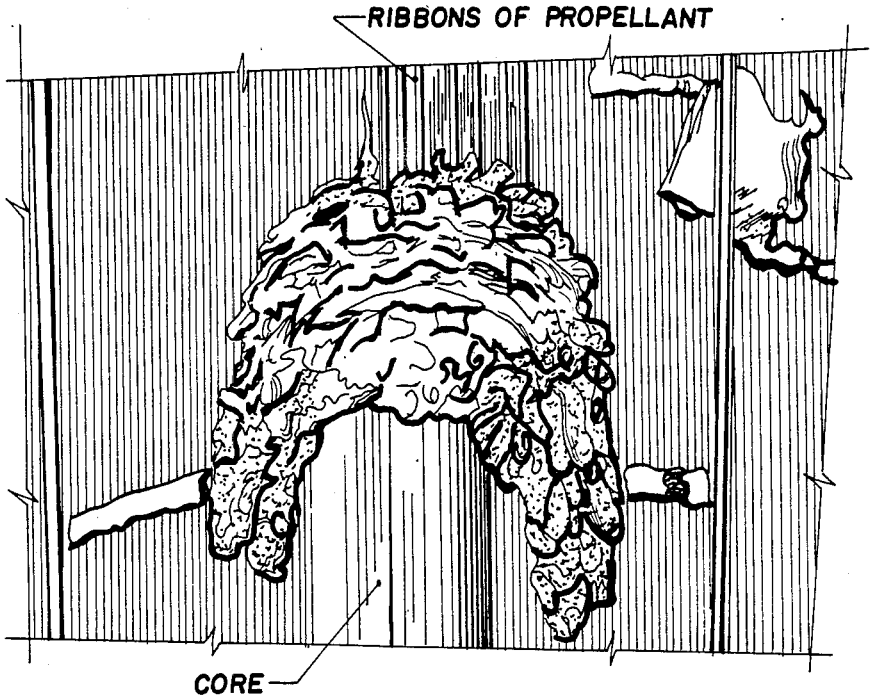
Fig. 2A PRIOR ART
FIGS. 2A and 2B illustrate a typical non uniform flow distribution pattern obtained with the prior art slit plate of FIG. 1, FIG. 2A showing ribbons of propellant flowing in unequal manner over the core about which the propellant is being cast, and FIG. 2B showing the formation of radially oriented interfaces and knit lines in the propellant grain cast.
Figure 2B:
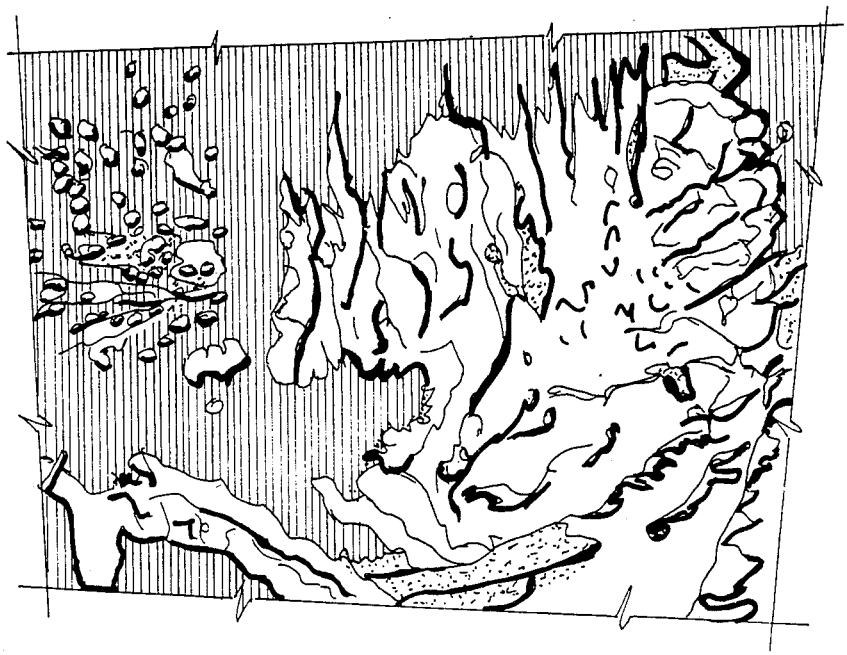

In a first embodiment of the slit plate, according to the invention, as illustrated in FIG. 3, the slit plate, designated by reference numeral 10 contains ⅛ inch (0.3175 cm.) wide radial slits 12 with a total cross sectional flow area of 2⅛ square inches (13.81 sq. cm.). Slits 12 are all of the same length and are uniformly spaced on plate 10.

Figure 4A:
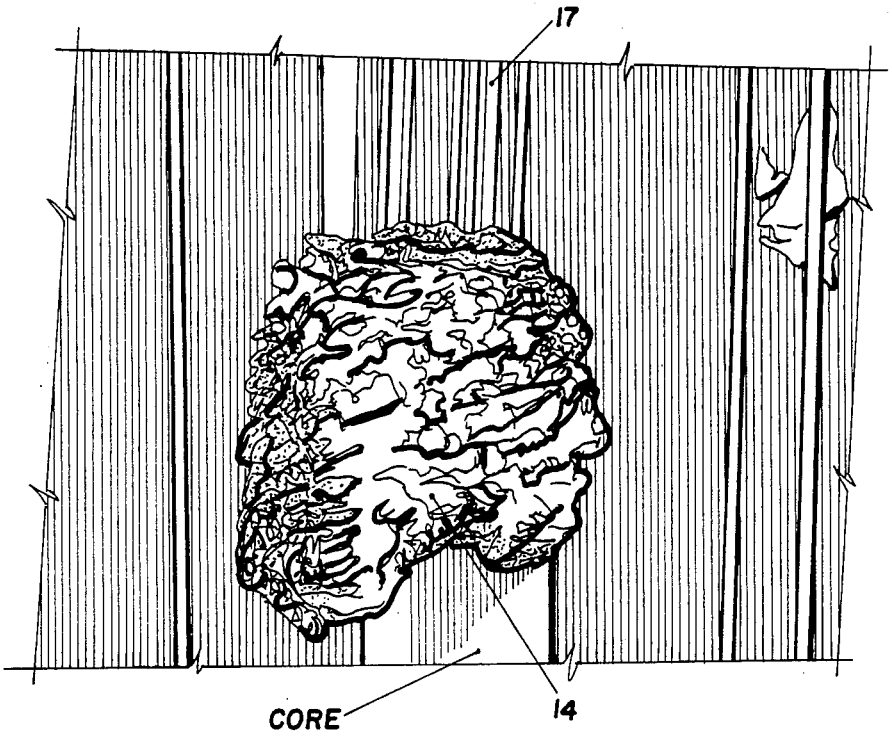
FIGS. 4A and 4B illustrate a uniform flow distribution pattern obtained with the slit plate of FIG. 3, FIG. 4A showing the ribbons of propellant flowing in uniform manner over the core about which the propellant is being cast.
Figure 4B:
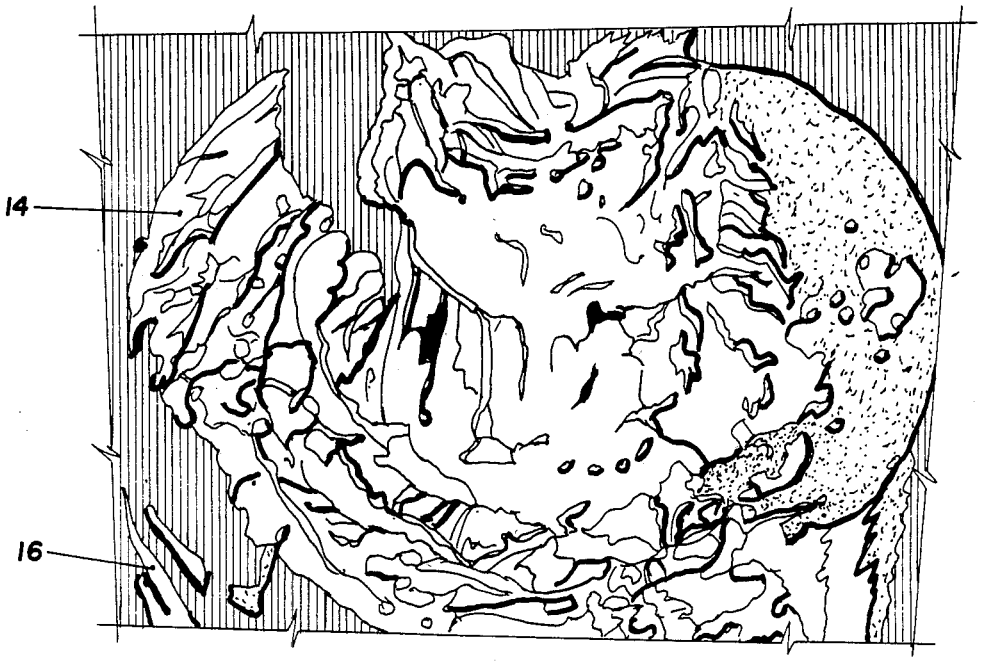

A solid propellant 14, as seen in FIG. 4A, was extruded through the radial slit plate 10, in a manner known and conventional to the art, into an evacuated plexiglass cylinder 16, the manner of evacuating cylinder 16 not being shown. When extruded through the slit plate 10, the solid propellant is formed into symmetrical, radially oriented, ribbons 17 all of which have substantially the same width. The extrusion rate was 6.9 pounds (3.14 Kg.) per minute. Photographic documentation of the test, as illustrated in FIGS. 4A and 4B indicates a uniform propellant flow pattern.

EXAMPLE 2

Figure 5:
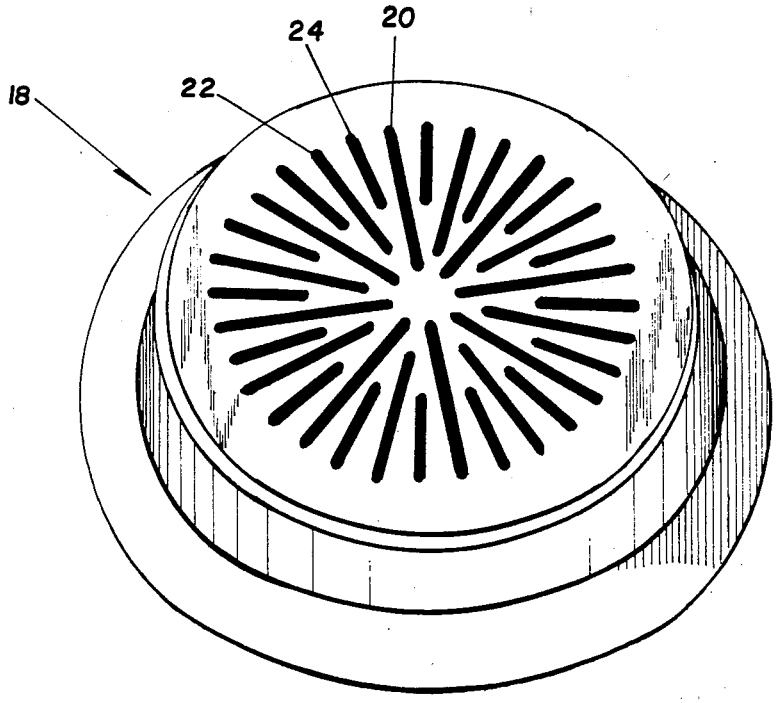
FIGS. 5 and 7 illustrate modified slit plate having radial skits according to the invention.

In a second embodiment of the slit plate according to the invention, as illustrated in FIG. 5, the slit plate 18 contains ⅛ inch (0.3175 cm.) wide radial slits with a total cross sectional flow area of 5¾ square inches (33.095 sq. cm.). Radial slits of three different lengths are provided in slit plate 18, the longest slits, designated by numeral 20 being uniformly spaced on slit plate 18, as shown in the drawing, with a slit 22 of intermediate length being centrally placed between each of the longest slits 20. The shortest slits, designated by numeral 24 are uniformly spaced on slit plate 18 with a slit 24 centrally placed between each of the longest slits 20 and the adjacent slits 22 of intermediate length. There are thus two short slits provided for every one of the longest slits 20 and intermediate length slits 22. Ribbons of corresponding width are produced as the propellant is extruded through the slits 20, 22 and 24 of different length.

Figure 6A:
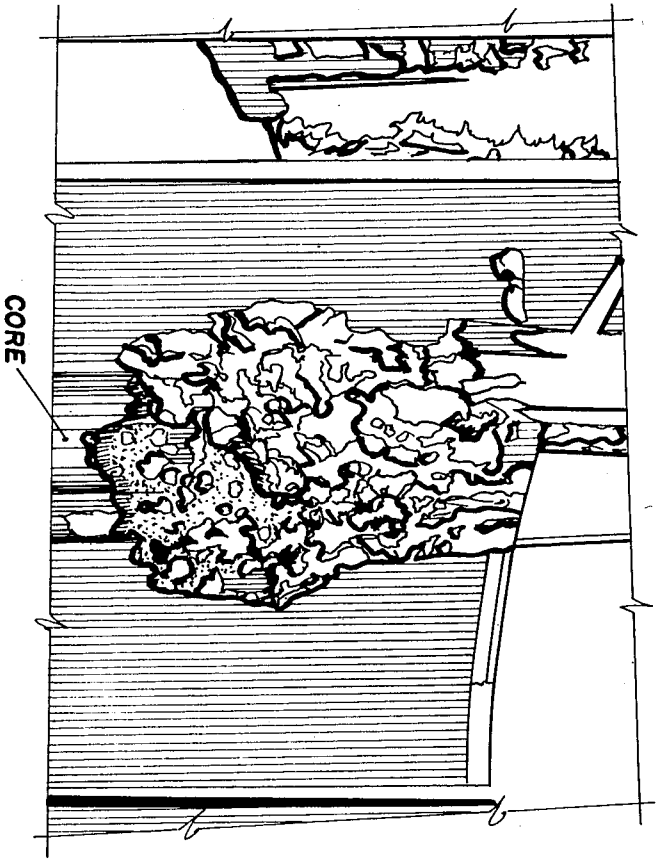
FIGS. 6A and 6B, and FIGS. 8A and 8B illustrate, respectively, the uniform flow distribution patterns obtained with the slit plates of FIGS. 5 and 7.
Figure 6B:
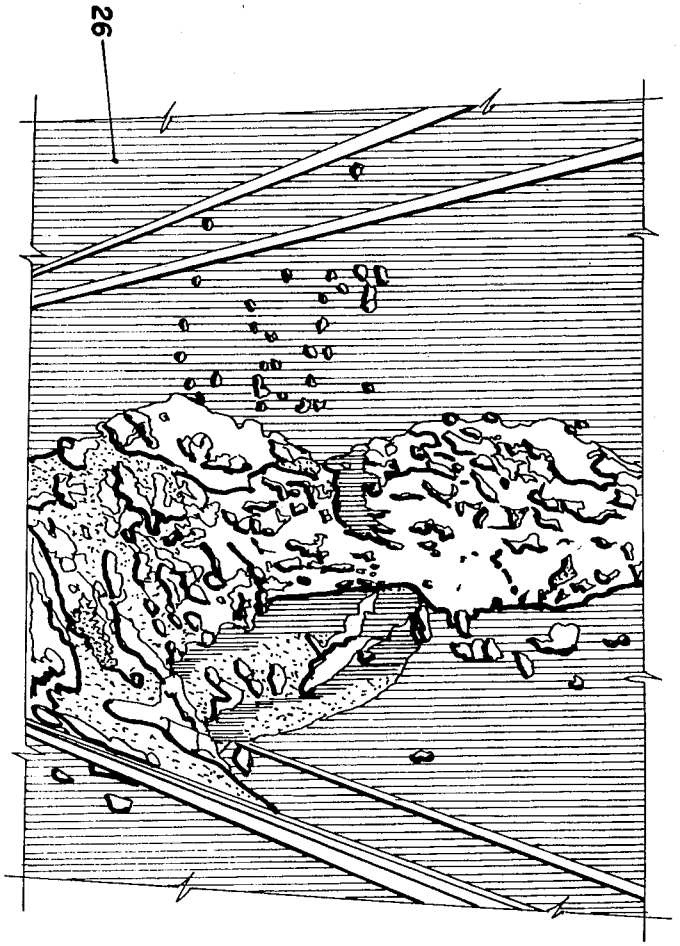

A solid propellant was extruded through the radial slit plate 18 in the manner described above in Example 1, into an evacuated plexiglass cylinder 26. The extrusion rate was 10.9 pounds (0.495 Kg.) per minute. Photographic documentation of the test, as illustrated in FIGS. 6A and 6B indicates a uniform propellant flow pattern.

EXAMPLE 3

Figure 7:
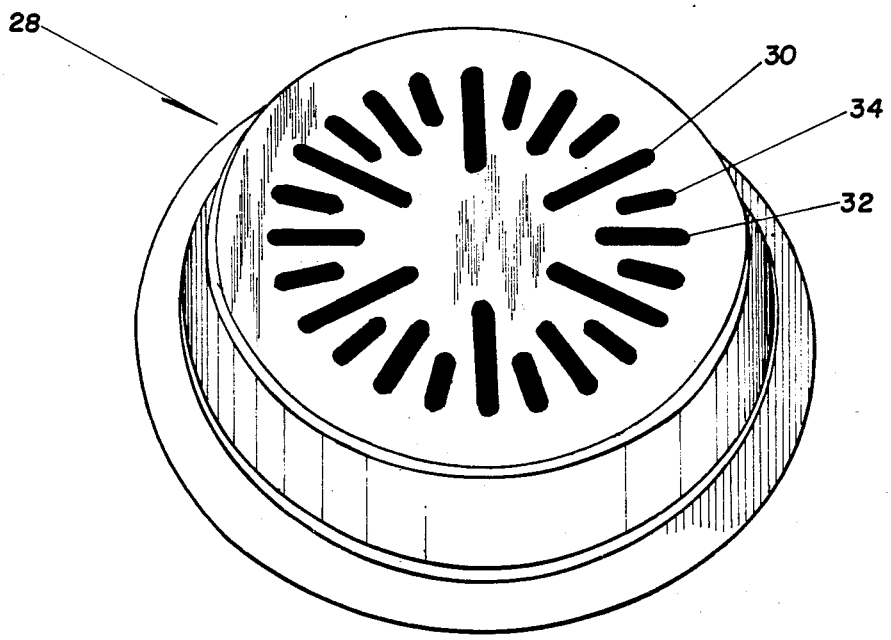

In a third embodiment of the slit plate according to the invention, as illustrated in FIG. 7, the slit plate 28 contains ¼ inch (0.635 cm.) wide radial slits. Radial slits of three different lengths are provided in the slit plate 28, the slits 30, 32 and 34 of longest, intermediate and shortest lengths, respectively, being arranged similarly to the corresponding slits 20, 22 and 24 of longest, intermediate and shortest lengths, respectively, of FIG. 5. The total cross sectional flow area of the slits 30, 32 and 34 of FIG. 7 is the same as that of the slits of FIG. 5, specifically 5¾ square inches (33.095 sq. cm.).

Figure 8A:
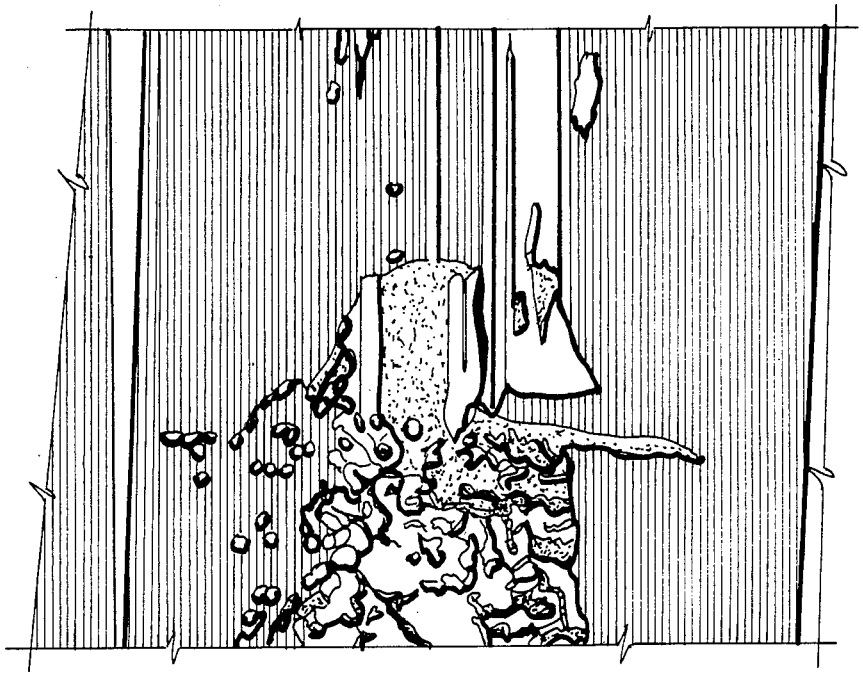
Figure 8B:
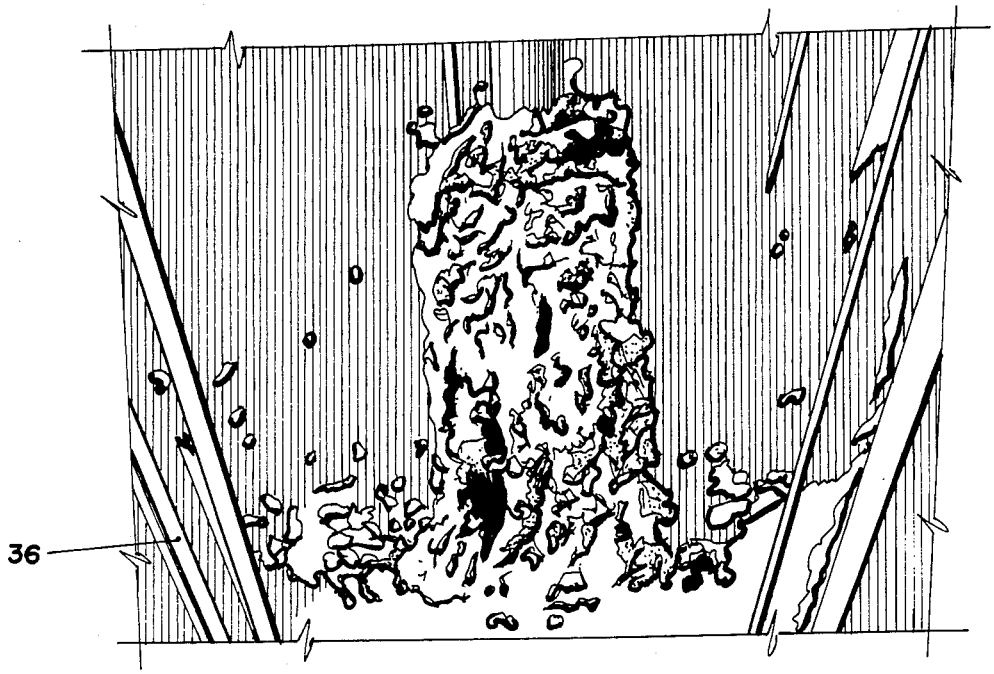

A solid propellant was extruded through the slit plate 28 in the manner described above in Example 1, into an evacuated plexiglass cylinder 36. The extrusion rate was 12.2 pounds (5.55 Kg.) per minute. Photographic documentation of the test, illustrated in FIGS. 8A and 8B, indicates a uniform propellant flow pattern.

Thus, there has been provided a method of and apparatus for deaerating solid rocket motor propellant that is characterized in providing a uniform propellant flow distribution during rocket motor casting. Uncured propellant is formed into symmetrical, radially oriented ribbons by being extruded through a radial slit plate into an evacuated chamber or rocket motor case. Entrapped air and volatiles are flashed from the ribbons of propellant that exit the slit plate. In each embodiment of the invention, the radial slit plate contains narrow slits originating near the center of the plate and extending radially toward the outer diameter of the plate.

As those skilled in the art will understand, the invention is not limited to the embodiments or examples that have herein been described, but includes any slit plate geometry containing symmetrical, radially oriented, slits or other perforations.

What is claimed is:

1. The method of providing a uniform flow distribution during casting of a solid propellant in an evacuated chamber comprising the step of introducing into the evacuated chamber uncured propellant in the form of symmetrical, radially oriented, ribbons.

2. The metood as defined in claim 1 wherein symmetrical, radially oriented ribbons of substantially the same width are introduced into the chamber.

3. The method as defined in claim 1 wherein symmetrical, radially oriented, ribbons of different width are introduced into the chamber.

4. The method as defined in claim 3 wherein symmetrical, radially oriented, ribbons of three different widths are introduced into the evacuated chamber, the ribbons being uniformly spaced and there being twice as many ribbons having the shortest width as there are ribbons of the intermediate and longest widths.

5. The method as defined in claim 1 wherein the chamber is formed in a rocket motor case.

6. The method as specified in claim 5 wherein the symmetrical, radially oriented, ribbons are formed by extruding the uncured propellant through a slit plate having radial slits therein.

7. The method as specified in claim 6 wherein the slit plate is circular and the slits therein originate near the center of the plate and extend radially toward the outer diameter thereof.

8. The method as specified in claim 7 wherein the radial slits in the slit plate all have substantially the same length.

9. The method as specified in claim 7 wherein the slit plate has radial slits of different lengths.

10. The method as specified in claim 9 wherein the slit plate has radial slits of three different lengths, there being twice as many slits having one shortest length as there are of the intermediate and longest lengths.

11. An apparatus for controlling the flow of uncured propellant during rocket motor casting operations, comprising:

a plate having a central region and an outward diameter; and radial slits in said plate extending radially from said central region towards the outer diameter of said plate;

said radial slits providing for the vacuum induced uniform flow of uncured propellant through said plate to form radially oriented ribbons of deaerated uncured propellant.

12. Apparatus as defined in claim 11 wherein the plate is circular and the slits originate near the center of the plate and extend radially toward the outer diameter thereof.

13. Apparatus as defined in claim 12 wherein the slits in the plate all have substantially the same length.

14. Apparatus as defined in claim 12 wherein slits of different lengths are provided in the plate, the slits being uniformly spaced and there being twice as many slits of the shortest length as there are slits of intermediate and longest lengths.

15. An apparatus for controlling the flow of uncured propellant during rocket motor casting operations, comprising:

a rocket motor having an evacuatble chamber therein, a plate in communication with said evacuatable chamber;

said plate having a central region and an outward diameter; and radial slits in said plate extending radially from said central region towards the outer diameter of said plate;

said radial slits providing for the uniform flow of uncured propellant through said plate to introduce radially oriented ribbons of uncured propellant into said evacuatable chamber when said evacuatable chamber of the rocket motor is evacuated.

16. The apparatus as defined in claim 15 wherein the plate is circular and the slits originate near the center of the plate.

17. The apparatus as defined in claim 16 wherein the slits in the plate all have substantially the same length.

18. The apparatus as defined in claim 16 wherein slits of different lengths are provided in the plate, the slits being uniformly spaced and there being twice as many slits of the shortest length as there are slits of intermediate and longest lengths.

* * * * *